United States Patent [19]

Kiuchi et al.

[11] Patent Number: 4,745,899

[45] Date of Patent: May 24, 1988

[54] METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

[75] Inventors: Takeo Kiuchi; Akimasa Yasuoka, both of Wako, Japan

[73] Assignee: Honda Giken Kogyo Kabushiki Kaisha, Toyko, Japan

[21] Appl. No.: 920,390

[22] Filed: Oct. 20, 1986

[30] Foreign Application Priority Data

Oct. 21, 1985 [JP] Japan ..... 60-233354

[51] Int. Cl.[4] ..... F02D 41/16

[52] U.S. Cl. ..... 123/339; 123/353; 123/361; 123/585

[58] Field of Search ..... 123/339, 352, 361, 585, 123/353, 354, 438, 571, 490, 357; 361/140

[56] References Cited

U.S. PATENT DOCUMENTS

| | | | |
|---|---|---|---|
| 4,134,373 | 1/1979 | Kibler et al. | 123/352 |
| 4,378,766 | 4/1983 | Yamazoe et al. | 123/339 |
| 4,446,410 | 5/1984 | Yagura et al. | 318/687 |
| 4,580,536 | 4/1986 | Takao et al. | 123/339 |
| 4,638,784 | 1/1987 | Ikeda | 123/571 |

FOREIGN PATENT DOCUMENTS

| | | | |
|---|---|---|---|
| 3344662 | 6/1985 | Fed. Rep. of Germany . | |
| 2350472 | 12/1977 | France . | |
| 59-176447 | 10/1984 | Japan | 123/339 |

OTHER PUBLICATIONS

Patent Abstracts of Japan, vol. 9, No. 142, Jun. 18, 1985; (JP-A-60-22050).

*Primary Examiner*—Andrew M. Dolinar
*Attorney, Agent, or Firm*—Armstrong, Nikaido, Marmelstein & Kubovcik

[57] ABSTRACT

A method and apparatus are provided for controlling the solenoid current of a solenoid valve which controls the amount of suction air in an internal combustion engine. The actual solenoid current flowing through the solenoid is detected and a solenoid current control valve is calculated as a function of engine operating conditions. A corrected solenoid current control value is determined as a function of the solenoid current control value and a pulse duration signal is determined as a function of the corrected solenoid current control value. A feedback control term is calculated as a function of the actual solenoid current and the corrected solenoid current control value. Further, a temperature corresponding to the solenoid temperature is detected and a temperature correction value is generated corresponding thereto. A pulse duration output signal is calculated for controlling the operation of said solenoid as a function of the pulse duration signal, the feedback control term, and the temperature compensation value.

6 Claims, 9 Drawing Sheets

METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

BACKGROUND OF THE INVENTION

This invention relates to a method and apparatus for controlling the solenoid current of a solenoid valve which controls the amount of suction air in an internal combustion engine, and more particularly, to a method and apparatus for controlling the solenoid current of a solenoid valve which controls the amount of suction air in an internal combustion engine wherein the solenoid current is controlled for proportionally controlling the opening of a solenoid valve connected in a by-pass path which couples the upstream and downstream sides of a throttle valve provided in a suction air path.

Referring to FIG. 11, it has been previously proposed that in idling of an internal combustion engine 10, the engine continues to run while a throttle valve 11, provided in a suction air path of the engine, is held in a substantially closed condition. The amount of suction air of the internal combustion engine is controlled by a solenoid valve 12 provided in a by-pass path 13 between the upstream and downstream side of the throttle valve in order to control the rotational speed of the engine (idling rotating speed). Such an idling rotational speed controlling method is disclosed in detail, for example, in Japanese patent application No. 60-137445.

The idling rotational speed controlling method in Japanese patent application No. 60-137445 includes a step of first calculating a solenoid current control value Icmd by an equation (1) given below in a central processor (CPU) 1 of a microprocessor 4 which further includes, as shown in FIG. 2, a storage unit or memory 2 and an input/output signal converting circuit or interface 3.

In order to calculate Icmd in the CPU 1, the interface 3 must be supplied with signals from various sensors suitably located in the engine (not shown). This is well known in the art.

$$Icmd=[Ifb(n)+Ie+Ips+Iat+Iac]\times Kpad \quad (1)$$

In equation (1), Ifb(n) is a feedback control term which is calculated in accordance with the flow chart of FIG. 3 which will be hereinafter described. Here, (n) indicates the present time value. The calculations of steps S41 to S46 of FIG. 3 are described as follows:

Step S41 . . . the value Me(n), which is the reciprocal of the engine rotational speed, is read.

Step S42 . . . a deviation ΔMef is calculated which is the difference between Me(n) thus read and Mrefo which is a reciprocal of a preset aimed idling rotational speed Nrefo.

Step S43 . . . a difference between Me(n) and a preceding time measured value Me for the same cylinder as Me(n) [in the case of a six cylinder engine, Me(n−6)], that is, a coefficient of variation ΔMe of the period, is calculated.

Step S44 . . . an integration term Ii, a proportion term Ip, and a differentiation term Id are calculated in accordance with respective equations indicated in the block of FIG. 3 for the Step S44 using ΔMe and ΔMef calculated above as well as an integration term control gain Kim, a proportion term control gain Kpm, and a differentiation term control gain Kdm. The control gains are obtained by recalling them from the memory 2 where they were stored in advance.

Step S45 . . . the integration term Ii obtained in the preceding Step S44 is added to Iai(n−1) to obtain Iai(n). Iai(n) obtained here is temporarily stored in the memory 2 so that this may be Iai(n−1) for the next cycle. However, when there is no value stored in the memory 2, some initial value of Iai may be stored in the memory 2 in advance to be read out therefrom as Iai(n−i).

Step S46 . . . Ip and Id calculated at Step S44 are added to Iai(n) calculated at Step S45 to obtain Ifb(n) which is defined as a feedback control term.

The terms in equation (1) other than Ifb(n) are defined as follows:

Ie . . . an addition correction term for adding a predetermined value in accordance with a load of an AC generator (ACG), that is, the field current of the ACG.

Ips . . . an addition correction term for adding a predetermined value when a pressure switch in a power steering hydraulic circuit is turned on.

Iat . . . an addition correction term for adding a predetermined value when the selector position of an automatic transmission AT is in the drive (D) range.

Iac . . . an addition correction term for adding a predetermined value when an air conditioner is operative.

Kpad . . . a multiplication correction term determined in accordance with the atmospheric pressure.

Icmd in equation (1) is calculated in response to TDC pulses produced by a known means when the piston of each cylinder is at an angle of 90° before its top dead center.

Icmd calculated by equation (1) is further converted in the CPU 1, for example, into a duty ratio of pulse signals having a fixed period. The CPU 1 contains a periodic timer and a pulse signal high level time (pulse duration) timer which operates in a synchronized relationship so that pulse signals having a predetermined high level time or duration are successively developed from the microprocessor 4 for each predetermined period. The pulse signals are applied to the base of a solenoid driving transistor 5. Consequently, the transistor 5 is driven to be turned on and off in response to the pulse signals.

Referring to FIG. 2, in response to the on state of the solenoid driving transistor 5, an electric current from battery 6 flows through a solenoid 7 and the transistor 5 to the ground. Accordingly, the opening of a solenoid valve is controlled in accordance with the solenoid current, and an amount of suction air corresponding to the opening of the solenoid valve is supplied to the internal combustion engine to control the idling rotational speed.

Conventionally in a feedback control mode of the engine rotational speed, a determined value Ixref(n) is calculated by equation (2), below, and stored into the memory 2.

$$Ixref(n) = Iai(n)\times Ccrr/m + Ixref(n-1)\times(m-Ccrr)/m \ldots \quad (2)$$

Iai(n) in equation (2) is a value calculated at Step S45 of FIG. 3 described above, and Ixref(n−1) indicates the value of the determined value Ixref for the preceding time period. Further, m and Ccrr are selected positive values, and m is selected greater than Ccrr.

The calculation of the value Ixref(n) is effected in response to a TDC pulse when predetermined requirements are met, such as, for example, a requirement that there is no external load such as an air conditioner, as is apparent from the above mentioned Japanese patent application No. 60-137445.

When the solenoid valve of the internal combustion engine turns from the feedback control mode to an open loop control mode which is effected during operation other than idling, a pulse signal is developed from the microprocessor 4 in response to Icmd which is equal to the determined value Ixref(n), and the current flowing through the solenoid 7 and hence the opening of the solenoid valve is held to a predetermined value corresponding to the determined value Ixref(n). This is because it is intended that the initial opening of the solenoid valve when the internal combustion engine switches from the open loop control mode back to the feedback control mode may approach as near as possible to the opening corresponding to Icmd in the feedback control mode so that the time before a stabilized normal control condition is reached may be shortened.

Icmd in the open loop control mode is calculated by the following equation (3), similar to equation (1) above, so that pulse signals corresponding to the Icmd thus calculated may be developed from the microprocessor 4.

$$Icmd=(Ixref+Ie+Ips+Iat+Iac)\times Kpad \quad (3)$$

If Icmd is calculated in this manner and the solenoid current is determined in accordance with pulse signals corresponding to Icmd when the internal combustion engine switches from the open loop control mode back to the feedback control mode, the initial opening is reached in which an external load such as, for example, an air conditioner, is taken in consideration. This is desirable because the time required before an opening corresponding to Icmd for the feedback control mode is reached is further shortened.

The techniques described above, however, have the following drawbacks:

The resistance component of the solenoid 7 changes in response to a change in the temperature as is well known in the art. Because the solenoid valve having the solenoid 7 is commonly located near an engine body, it is readily influenced by the temperature of the engine. Accordingly, the resistance component of the solenoid 7 is readily changed.

If the resistance component of the solenoid 7 changes, a solenoid current corresponding to Icmd will not flow, and as a result, the opening of the solenoid valve which is expected by Icmd will not be attained. However, during feedback control, if a predetermined time elapses with feedback control of the engine rotational speed in accordance with FIG. 3 and equation (1), coincidence with an aimed idling rotation speed will be reached. However, the PID coefficient (control gain) of the feedback control term Ifb(n) is normally set to a small value with the stability during normal idling being taken into consideration. Accordingly, feedback control based on Ifb(n) is normally done slowly. Consequently, the techniques have a drawback in that when the resistance component of the solenoid 7 changes, a long period of time is required until the engine rotational speed reaches the aimed idling rotational speed after the feedback control has started.

Further, the techniques have another drawback in that when there is a difference in temperature around the solenoid 7 between a point in time when the determined value Ixref is calculated, during feedback control, and another point in time when the determined value Ixref is used as an initial value for feedback control, or when the temperature around the solenoid 7 exhibits a change while the opening of the solenoid valve is under open loop control, the resistance of the solenoid 7 will change and thus, a desired opening of the solenoid valve, that is, the opening which is expected by Icmd, will not be reached.

A means which resolves such drawbacks has been proposed by the present applicant which includes, in addition to a conventional engine rotational speed feedback control system, a current feedback control system for feeding back an actual electric current flowing through a solenoid 7 whereby a solenoid current control value calculated in the engine rotational speed feedback control system, is corrected with a correction value calculated by the current feedback control system in a manner described below, and a signal, determined depending upon the thus corrected solenoid current control value, is applied to a solenoid current controlling means to control the solenoid current.

The corrected value is obtained by detecting an actual solenoid current, calculating a deviation of the actual solenoid current from the solenoid current control value, multiplying the deviation by a proportional term control gain to calculate a proportional term while multiplying the deviation by an integration term control gain and adding a preceding time integration term to the thus multiplied deviation to calculate an integration term, and then adding the integration term to the proportion term.

To describe the foregoing method in summary, even if, for example, the resistance component of the solenoid 7 changes such that a condition occurs in which a solenoid current does not correspond to a solenoid current control value, control of the current feedback control system will result in a solenoid current corresponding to the solenoid current control value.

In the technique described above wherein the current feedback control system is provided in addition to an engine rotational speed feedback control system there are the following disadvantages.

(1) Individual control gains for proportion and integration terms in the current feedback control system are normally set to low values taking into account stability during normal idling. Accordingly, even if an attempt is made to provide a solenoid current corresponding to a solenoid current control value under control of the current feedback control system, since the resistance component of the solenoid 7 varies such that a condition occurs in which a solenoid current corresponding to the solenoid current control value does not flow, such a predetermined current value cannot be immediately obtained. As a result, the engine rotational speed will temporarily fluctuate (for example, become lowered).

(2) Although calculation of an integration term for calculating a corrected value is effected by multiplying a deviation by an integration term control gain and adding a preceding time integration term to the thus multiplied deviation, upon starting of current feedback control, that is, when an ignition switch is turned on to start the engine, there is no preceding time integration term or value yet calculated. Thus, a method can be used wherein a corrected value is determined and the thus determined value is used as a preceding time integration value upon starting of current feedback control. Using this method, the period time before the solenoid current reaches a value corresponding to a solenoid current control value is shortened as compared with the case wherein the preceding time integration value is set to zero, and accordingly, the engine rotational speed can rise rapidly to a predetermined rotational speed corresponding to the solenoid current control value.

Besides, since there is variation in characteristics among individual solenoid valves, there is a variation in time before the solenoid current reaches a value corresponding to the solenoid current control value. Consequently, there will be a variation in time before the engine rotational speed rises to the predetermined rotational speed corresponding to the solenoid current control value. But if a determined value is used as described hereinabove, the variation will become very small because the period of time before the solenoid current reaches a value corresponding to the solenoid current control value is shortened.

However, where a correction value as described above varies widely in response to a change in a resistance component depending upon a change in temperature of a solenoid, a determined value will involve a change in temperature of the solenoid and hence an appropriate value will not be assured. This is because a determined value is used as a preceding time integration value when the engine is started as described above, and hence the solenoid will not be significantly influenced by the temperature of the engine.

SUMMARY OF THE INVENTION

It is an object of the present invention to provide a method and apparatus for controlling the solenoid current of a solenoid valve which controls the amount of suction air in an internal combustion engine wherein correction is provided for changes in solenoid resistance as a result of changes in solenoid temperature. The present invention is directed to a method and apparatus for controlling the solenoid current of a solenoid valve which controls the amount of suction air in an internal combustion engine. The actual solenoid current flowing through the solenoid is detected and a solenoid current control value is calculated as a function of engine operating conditions. A corrected solenoid current control value is determined as a function of the solenoid current control value and a pulse duration signal is determined as a function of corrected solenoid current control value. A feedback control term is calculated as a function of the actual solenoid current and the corrected solenoid current control value. Further, a temperature corresponding to the solenoid temperature is detected and a temperature correction value is generated corresponding thereto. A pulse duration output signal is calculated for controlling the operation of said solenoid as a function of the pulse duration signal, the feedback control term, and the temperature compensation value.

DETAILED DESCRIPTION OF THE PREFERRED EMBODIMENT

Figure 2:
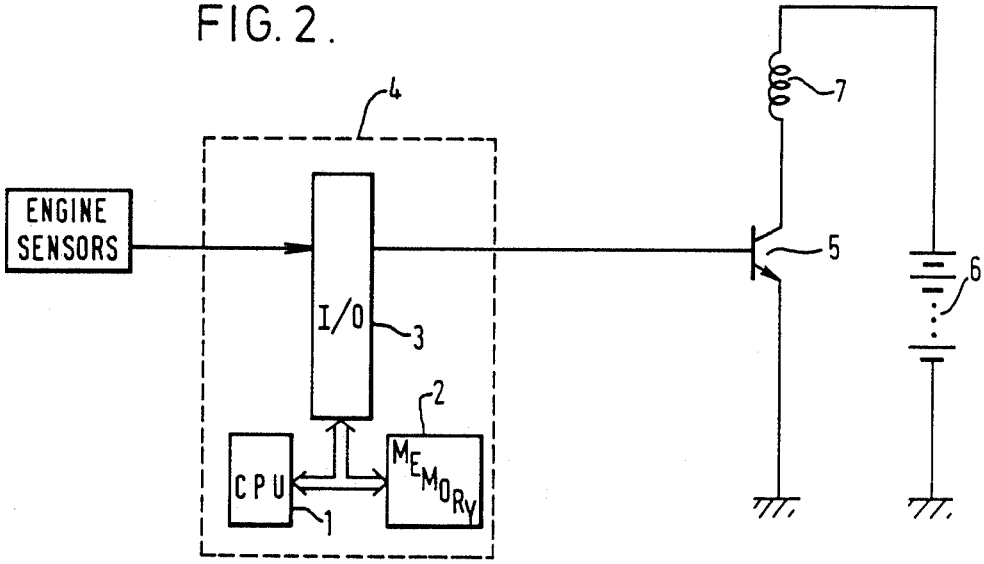
FIG. 2 is a circuit diagram showing a conventional solenoid current controlling device.
Figure 4:
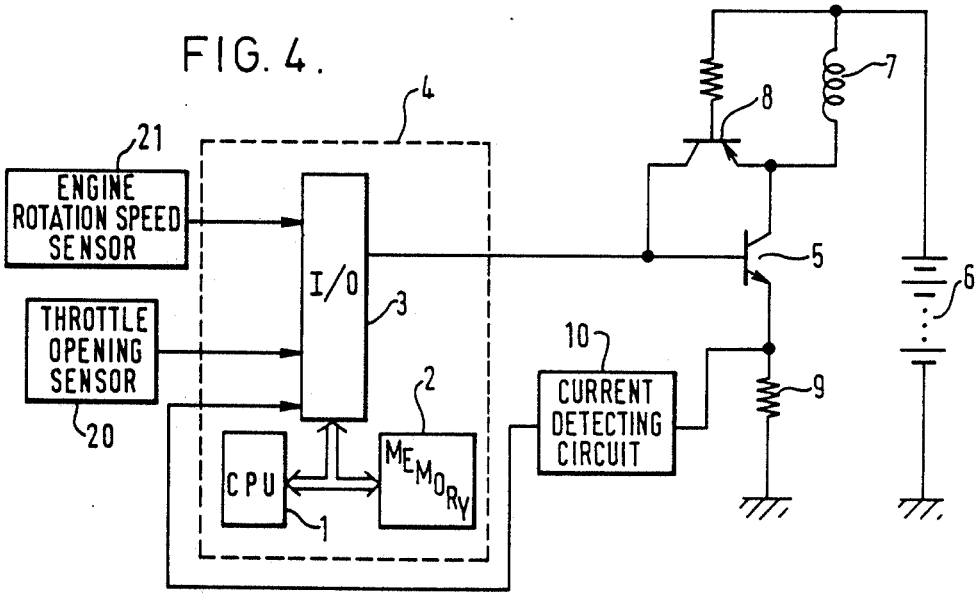
FIG. 4 is a circuit diagram showing an embodiment of solenoid current controlling device of the present invention.

FIG. 4 is a circuit diagram illustrating a solenoid current controlling device of the present invention. Referring to FIG. 4, like reference symbols denote the same or equivalent parts as those of FIG. 2.

When a pulse signal obtained in a manner hereinafter described, is output from a microprocessor 4, it is applied to the base of a solenoid driving transistor 5, and the transistor 5 is driven on or off in response to the pulse signal.

In FIG. 4, when the transistor 5 is on, current from a battery 6 flows through a solenoid 7, the transistor 5 and a resistor 9 to ground. Consequently, the opening of a solenoid valve (not shown) is controlled in response to the solenoid current. When the transistor 5 is interrupted in response to the falling edge of a pulse signal from the microprocessor 4, a back electromotive force is generated in the solenoid 7. Transistor 8 is rendered conductive in response to such a back electromotive force so that the transistor 5 is kept on while the back electromotive force continues to be produced. The entire current variation of the solenoid current may thus be detected as a voltage drop across the resistor 9.

A current detecting circuit 10 supplies the actual current value Iact through the solenoid 7 which is detected as a voltage drop across the resistor 9, to an interface 3. The interface 3 converts the output of the current detecting circuit 10, and accordingly, the actual current value Iact flowing through the solenoid 7, into a digital signal.

Now, the operation of generating a pulse signal which is an output of the microprocessor 4 to which the method of the present invention is applied will be described with reference to FIGS. 1A and 1B which are a flow chart illustrating the operation of the microprocessor 4 with which the present invention is used.

Figure 1A:
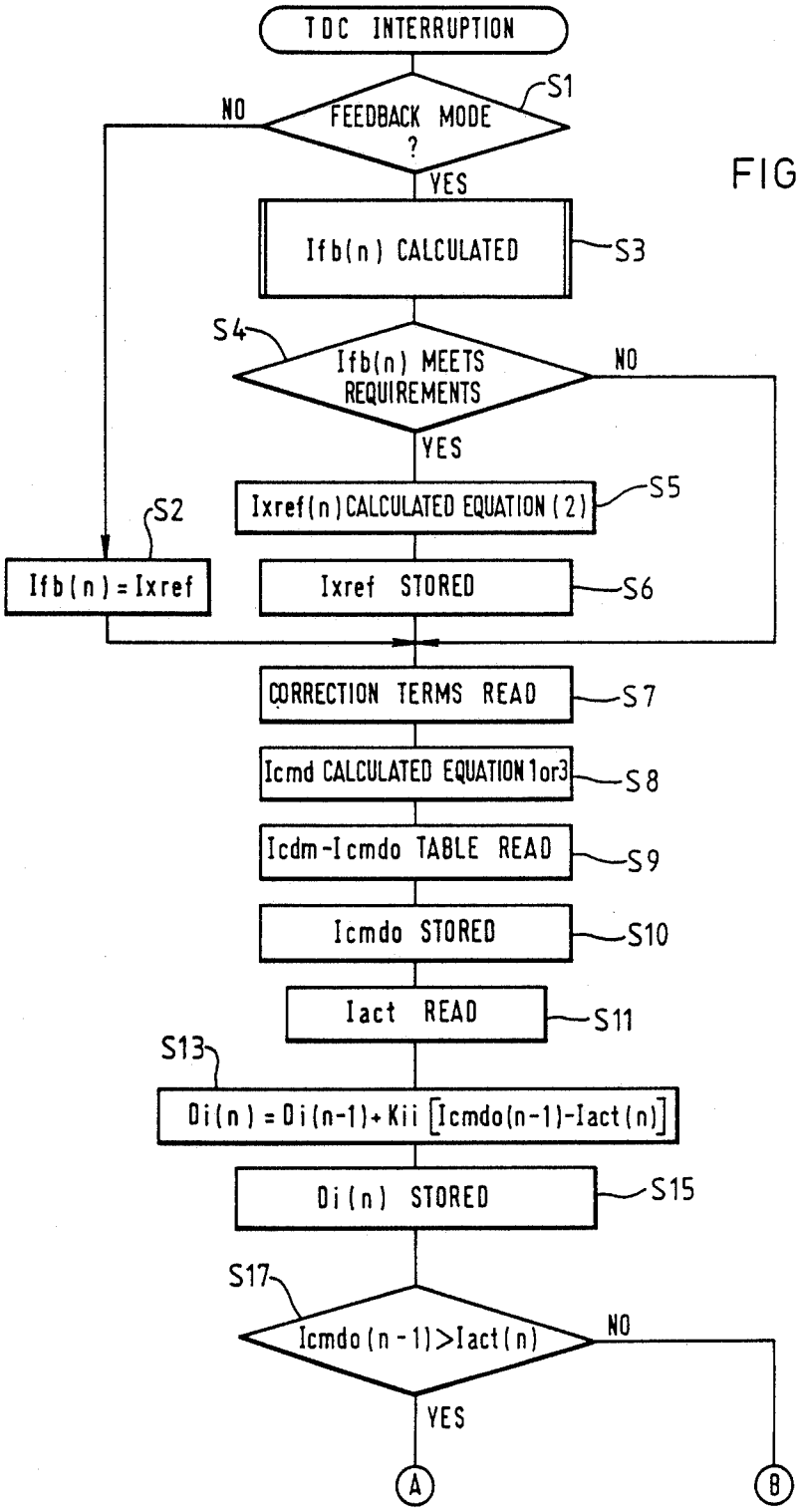
FIGS. 1A and 1B are a flow chart illustrating operation of a microprocessor to which of the present invention is applied.
Figure 1B:
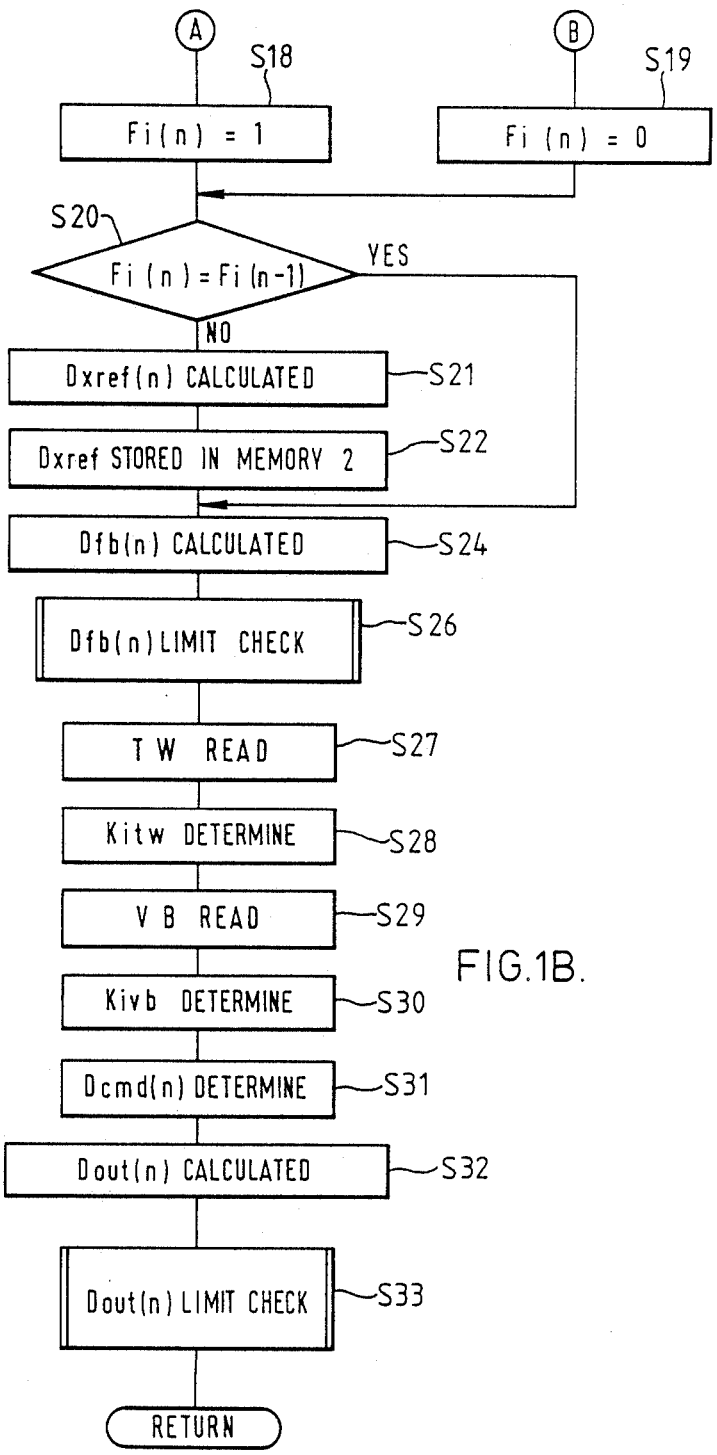

Operation of the flow chart of FIGS. 1A and 1B is started by interruption by TDC pulses.

Step S1 . . . it is determined whether or not the engine is in an engine rotational speed feedback control mode (feedback mode) which stabilizes idling rotational speed to stabilize the control valve, wherein, the opening of the solenoid valve is controlled in response to a solenoid current.

More particularly, when it is determined from a signal supplied from a throttle opening sensor 20 that a throttle valve is in a substantially fully closed condition and it is also determined from a signal supplied from an engine rotational speed sensor 21 that the engine rotational speed is in a predetermined idling rotational speed region, it is determined that the solenoid valve is in the feedback mode, and the program advances to Step S3. In any other case, the program advances to Step S2.

Step S2 . . . as a feedback control term Ifb(n), a preceding determined value Ixref which has been stored in the memory 2 at Step S6 which will also be described below is adopted. When there is no determined value Ixref stored in the memory 2, a value likely to the determined value, which has been stored in memory 2 in advance, is read out as a determined value Ixref. The program then advances to Step S7 described below.

Figure 3:
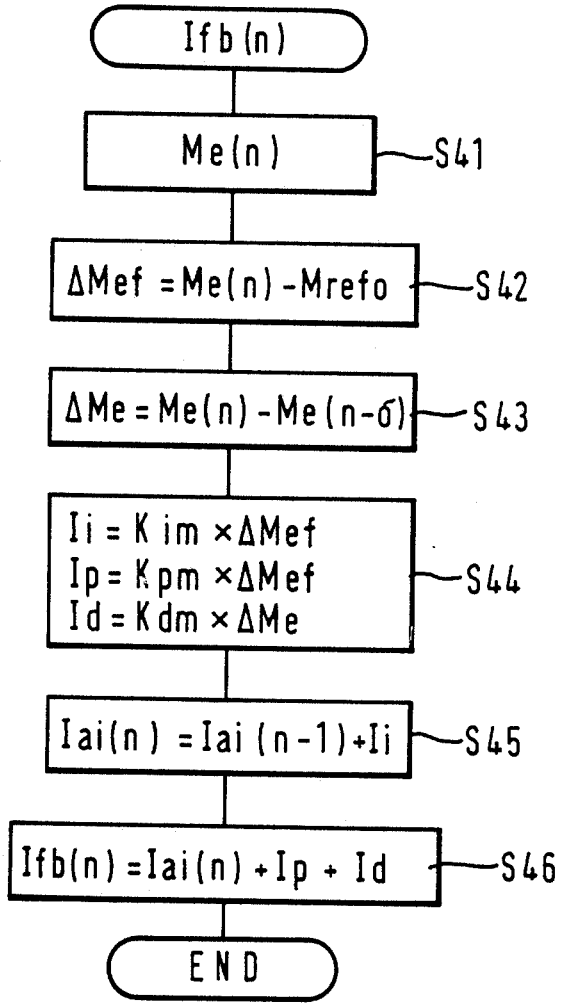
FIG. 3 is a flow chart for calculating a feedback control term Ifb(n).

Step S3 . . . Ifb(n) is calculated by calculation for the engine rotational speed feedback control mode in such a manner as described above in connection with FIG. 3.

Step S4 . . . it is determined whether or not the predetermined requirements for allowing appropriate calculation of the determined value Ixref(n) at Step S5 described below, are met. Particularly, it is determined whether or not the predetermined requirements are met in that the car speed is lower than a predetermined level V1 and that there are no external loads such as an air conditioner and power steering. When the determination is negative, the program advances to Step S7, and when it is affirmative, the program advances to Step S5. It is to be noted that while it is necessary to provide various sensors which develop outputs applied to the interface 3 in order to determine the requirements as described above, this is well known in the art and hence such sensors are not shown in FIG. 4.

Step S5 . . . a determined value Ixref(n) is calculated using equation (2) described above.

Step S6 . . . the determined value calculated at Step S5 is stored in the memory 2.

Step S7 . . . values of the individual correction terms of equation (1) or (3), that is, the addition correction terms Ie, Ips, Iat and Iac and the multiplication correction term Kpad, are read in. In order to read in the various values, it is necessary to provide sensors which provide sensor outputs to the interface 3, similarily to Step S4. However, because this is also well known in the art, such sensors are not shown in FIG. 4.

Step S8 . . . a solenoid current control value Icmd is calculated by equation (1) above. Where Step S2 has been passed through, the value Icmd is calculated by equation (3).

In the present invention, the addition and multiplication correction terms may not necessarily be limited to those appearing in equation (1) or (3), and other correction terms may be added. However, it is naturally necessary to read in values for such additional correction terms in advance at Step S7 above.

Figure 5:
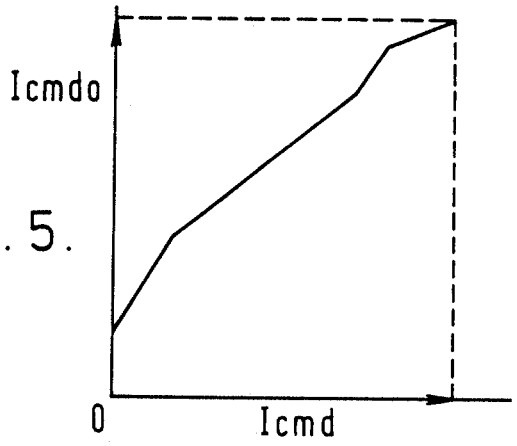
FIG. 5 is a diagram showing a relationship between a solenoid current control value Icmd and a corrected current control value Icmdo.

Step S9 . . . an Icmd - Icmdo table, which has been stored in advance in the memory 2, is read out in response to the solenoid current control value Icmd to determine a corrected current control value Icmdo. FIG. 5 is a diagram showing an example of the relationship between the solenoid current control value Icmd and the corrected current control value Icmdo.

The provision of the Icmd - Icmdo table is necessary for the following reason. Icmd is a value which is determined, in the feedback mode, from the engine rotational speed feedback control term Ifb(n) and the other correction terms as is apparent from equation (1) and is a theoretical value for controlling the opening of a solenoid valve within a range from 0% to 100% in order to bring the engine rotational speed close to an aimed idling rotational speed. However, the opening characteristic of a solenoid valve does not exhibit a linear proportional relationship with respect to the electric current fed thereto. Therefore, it is necessary to correct Icmd taking the characteristics of the solenoid valve into consideration in order that the opening of the actual solenoid valve may be controlled in a linear manner from 0% to 100%. This is the reason why the Icmd - Icmdo table is provided.

Step S10 . . . the corrected current control value Icmdo determined at Step S9 above is stored in the memory 2.

Step S11 . . . an actual current value Iact supplied from the current detecting circuit 10 is read in.

Step S13 . . . an integration term Di(n) for current feedback control is calculated in accordance with the equation indicated in block S13 using a preceding time corrected current control value Icmdo(n−1) which has been stored at Step S9 above, the present actual current value Iact read in at Step S11 above, an integration term control gain Kii which has been stored in advance in the memory 2, and a preceding time integration term Di(n−1). Where there is no Di(n−1) stored in the memory 2, a preceding determined value Dxref which has been stored in the memory 2 at Step S22 described below is used as Di(n−1). (This value is stored in a backup RAM within memory 2 which is powered by an independent power supply). Such a condition occurs when the ignition switch is turned on to start the engine and current feedback control first begins, that is, at the first processing of Step S13.

Similarily, since Icmdo(n−1) is not yet stored at Step S10 above immediately after the ignition switch has been turned on, a value of Icmdo corresponding to Icmd=0 of FIG. 5 is used as Icmdo(n−1).

Step S15 . . . Di(n) calculated at Step S13 is stored in the memory 2.

Step S17 . . . a present time actual current value Iact(n) is compared with the preceding time corrected current control value Icmdo(n−1) stored in the memory 2 at Step S10 in order to determine whether or not it is smaller than Iact(n). When the determination is affirmative, that is, when the actual current value Iact(n) is smaller than the value Icmdo(n−1), the program advances to Step S18, but when the determination is negative, the program advances to Step S19.

Step S18 . . . "1" is set as a present time flag Fi(n). The flag is temporarily stored in the memory 2 so that it can be used as a flag Fi(n−1) in the next cycle. The program then goes to Step S20.

Step S19 . . . "0" is set as a present time flag Fi(n). The flag is temporarily stored in the memory 2 so that it can be used as a flag Fi(n−1) in the next cycle.

Step S20 . . . if the present time flag Fi(n) is equal to the preceeding flag Fi(n−1), Step S21 and Step S22 are bypassed and the program advances to Step S24. When the flags are not equal to each other, or in other words, when the present time actual current value Iact(n) crosses the preceding corrected current control value Icmdo(n−1), an appropriate determined value Dxref(n)

for current feedback control can be obtained, and the program advances to Step S21.

Step S21 . . . a determined value Dxref(n) as defined by equation (4) below is calculated.

$$Dxref(n)=Di(n)\times Ccrr/m+Dxref(n-1)\times(m-Ccrr)/m \quad (4)$$

Di(n) in equation (4) is a value calculated at Step S13 above and stored in the present time value memory while Dxref(n−1) indicates a preceding time value of the determined value Dxref. Further, m and Ccrr are predetermined positive numbers, and m is selected greater than Ccrr.

Step S22 . . . the present determined value Dxref calculated at Step S21 is stored in the memory 2.

Step S24 . . . a feedback control term Dfb(n) is calculated by equation (5A) below using the preceding corrected current control value Icmdo(n−1) stored at Step S10 above, the present time actual current value Iact(n) read in at Step S11 above, a proportion term control gain Kip which has been stored in advance in the memory 2, and the integration term Di(n) stored in the present time value memory.

$$Dfb(n)=Dp(n)+Di(n) \quad (5A)$$

$$Dp(n)=Kip[Icmdo(n-1)-Iact(n)] \quad (5B)$$

$$Di(n)=Di(n-1)+Kii[Icmdo(n-1)-Iact(n)] \quad (5C)$$

Calculations of current deviations of the integration term Di(n) and the proportion term Dp(n) of equations (5C) and (5B) are effected based on the preceding corrected current control value Icmdo(n−1) and the present time actual current value Iact(n). This is because even if the corrected current control value Icmdo changes, the actual current value Iact does not immediately show a change due to the inductance of the solenoid and it takes a period of time for the actual current Iact to become stabilized after a change in Icmdo. Hence, calculations of the integration term Di(n) and the proportion term Dp(n) based on deviations of the present time values of the corrected current control value Icmdo and the actual current value Iact will cause errors in the individual terms, resulting in an error in the calculation of an appropriate feedback control term Dfb(n). Further, an appropriate determined Dxref at Step S21 above will not be assured.

The integration term Di(n) and the proportion term Dp(n) at Step S24 are not electric current values but values, for example, converted into high level pulse durations (hereinafter referred to as pulse durations) of pulse signals having a fixed period. This is because the specified terms obtained as electric current values are converted into pulse durations using a known table of electric current value I-pulse duration D. Accordingly, the feedback control term Dfb(n) is also obtained as a pulse duration. In addition, the determined value Dxref(n) of the integration term Di(n) obtained at Step S21 above is also a pulse duration.

Step S26 . . . limit checking of Dfb(n) is effected in a manner as hereinafter described with reference to FIG. 8.

Step S27 . . . a temperature corresponding to the temperature of the solenoid 7 is read in. Since the solenoid valve is of the type wherein cooling water for the engine is circulated around the solenoid valve to prevent freezing thereof, it is considered that the temperature of the solenoid 7 corresponds to the temperature TW of the cooling water for the engine, and thus the engine cooling water temperature is read as a temperature corresponding to the temperature of the solenoid 7 by way of a sensor (not shown).

Figure 13:
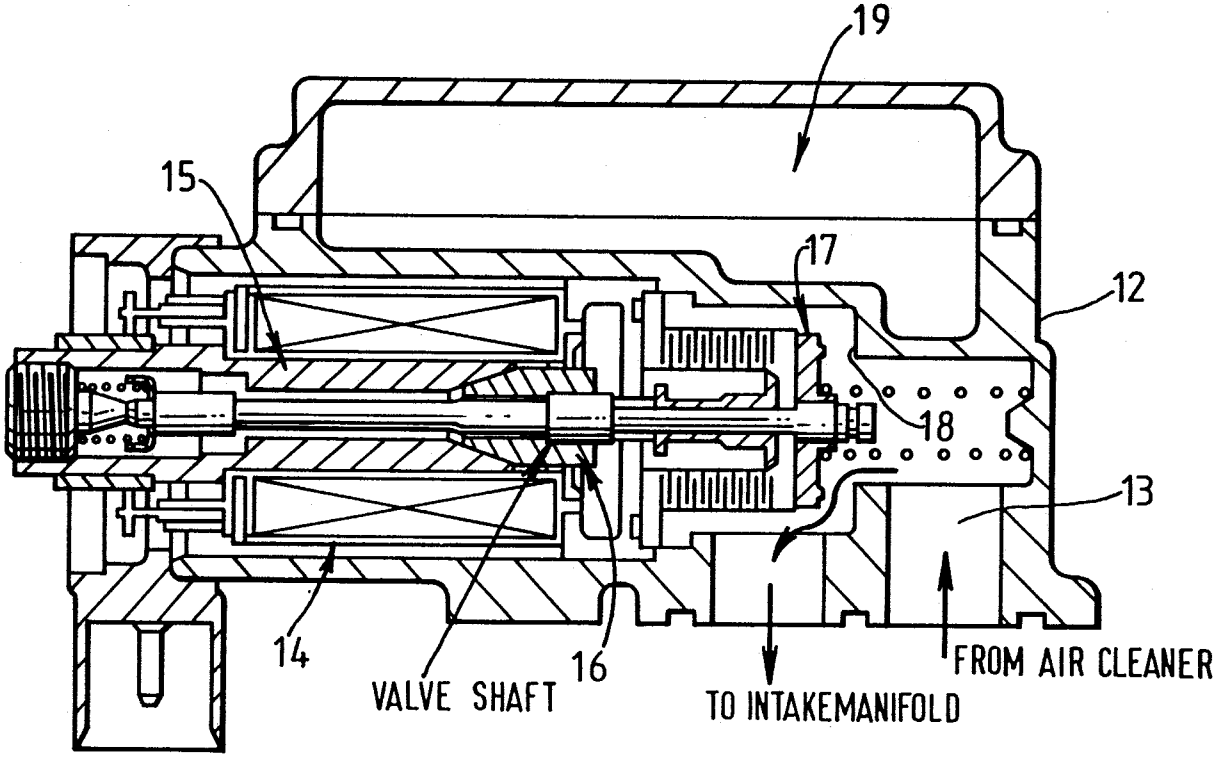
FIG. 13 illustrates a water cooled solenoid valve used in the present invention.

FIG. 13 illustrates a solenoid valve of the type in which cooling water for the engine circulates around the valve. Valve 12 includes a coil 14, stator core 15 and moving core 16. Valve member 17, which is operatively connected to moving core 16, cooperates with valve seat 18 to open and close air passage 13. Valve 12 also has a cooling water passage 19 through which engine cooling water circulates.

Figure 12:
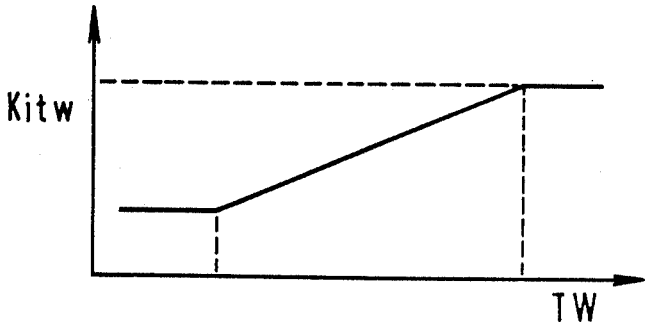
FIG. 12 is a diagram showing a relationship between the engine cooling water temperature TW and a temperature correction value Kitw.

Step S28 . . . A TW - Kitw table, which has been stored in advance in the memory 2, is read out in accordance with the engine cooling water temperature TW to determine a temperature correction value Kitw. FIG. 12 is a diagram showing a relationship between the engine cooling water temperature TW and the temperature correction value Kitw.

Step S29 . . . the voltage VB of the battery 6 is read by a sensor (not shown).

Figure 6:
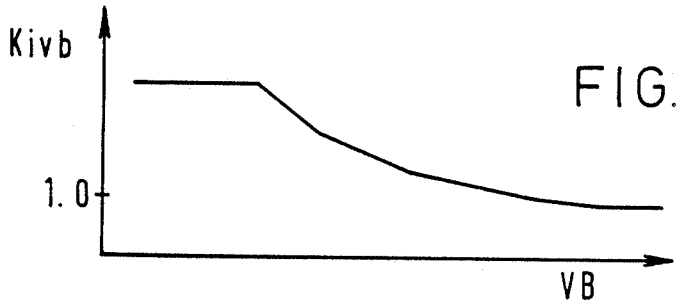
FIG. 6 is a diagram showing a relationship between a battery voltage VB and a battery voltage correction value Kivb.

Step S30 . . . a VB - Kivb table, which has been stored in advance in the memory 2, is read out to determine a battery voltage correction value Kivb based upon the battery voltage VB. FIG. 6 is a diagram showing the relationship between the battery voltage VB and the battery voltage correction value Kivb. As is apparent from the diagram, the battery voltage correction value Kivb is "1.0" when the battery voltage VB is higher than a predetermined voltage (for example, higher than 12 V), but if VB falls, the value will become correspondingly higher than 1.0 to maintain constant current.

Figure 7:
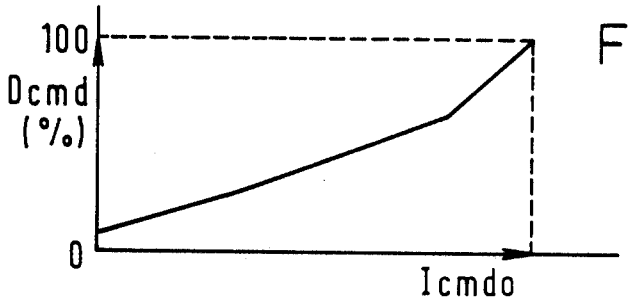
FIG. 7 is a diagram showing a relationship between the corrected current control value Icmdo and a pulse duration Dcmd.

Step S31 . . . an Icmdo - Dcmd table, which has been stored in advance in the memory 2, is read out to determine a pulse duration Dcmd(n) from the corrected current control value Icmdo(n) stored at Step S10 above. FIG. 7 is a diagram showing the relationship between the corrected current control value Icmdo and the pulse duration Dcmd.

If the pulse duration Dout(n) of a pulse signal which is generated and is outputted from the microprocessor 4, varies, then the solenoid current varies relative to the corrected current control value Icmdo, that is, a deviation of the solenoid current occurs, and hence, the amount of actually sucked air varies and an error will appear. The table described above defines the relationship between Icmdo and Dcmd in such a manner as to eliminate such an error.

Step S32 . . . a pulse duration Dout(n) of a pulse signal, which is a final output of the microprocessor 4, is calculated by equation (6) below using Dcmd(n) determined at Step S31 above, Dfb(n) calculated at Step S24 and checked for limits at Step S26, the temperature correction value Kitw determined at Step S28, and the battery voltage correction value Kivb determined at Step S30.

$$Dout(n)=Kivb\times Kitw\times[Dcmd(n)+Dfb(n)] \quad (6)$$

Thus, Dout(n) is determined by adding Dfb(n) of the current feedback control system which is determined based on a deviation of the present time actual current value Iact(n) from the preceding corrected current control value Icmdo(n−1) to Dcmd(n) which is determined based on the corrected current control value Icmdo for the engine rotational frequency feedback control system to determine a pulse duration and by multiplying the pulse duration thus calculated by the temperature correction value Kitw and the battery voltage correction value Kivb.

In other words, while feedback control of a solenoid current is effected, in the present invention, in order to approximate the solenoid current to a corrected current control value Icmdo, the fluctuation of the solenoid current caused by a change in temperature of the solenoid 7 is substantially compensated for by the temperature correction value Kitw. Accordingly, fine compensation such as the compensation for a fluctuation of the solenoid current which cannot satisfactorily be compensated for by the Kitw is effected for Dfb(n). Therefore, the determined value Dxref(n) calculated at Step S21 involves little correction of the solenoid current based upon a change in temperature of the solenoid 7.

Step S33 . . . limit checking is effected in a manner hereinafter described with reference to FIG. 9. After this, the process returns to the main program. Thus, the microprocessor 4 successively develops pulse signals having the pulse duration Dout(n).

Figure 8:
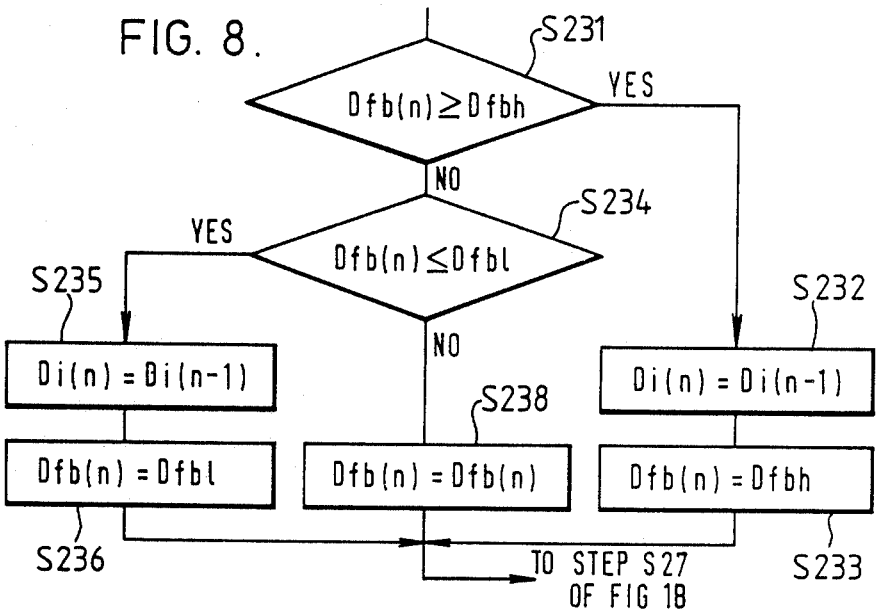
FIG. 8 is a flow chart illustrating contents of calculations at Step S26 of FIG. 1B.

FIG. 8 is a flow chart illustrating the contents of the calculation at Step S26 of FIG. 1.

Step S231 . . . it is determined whether or not Dfb(n) calculated at Step S24 of FIG. 1 is greater than a certain upper limit Dfbh. When the determination is negative, the program advances to Step S234, and when the determination is affirmative, the program advances to Step S232.

Step S232 . . . the preceding integration value Di(n−1), which is stored in the memory 2, is stored as the present integration value Di(n).

Step S233 . . . Dfb(n) is set to its upper limit, that is, Dfbh. The program then advances to Step S27 of FIG. 1.

Step S234 . . . it is determined whether or not Dfb(n) is smaller than a certain lower limit Dfbl. When the determination is negative, Dfb(n) is considered to be within an appropriate range defined by the limits, and the program advances to Step S238. However, when the determination is affirmative, the program goes to Step S235.

Step S235 . . . the preceding integration value Di(n−1) is stored in the present time value memory in a similar manner as at Step S232 above.

When Dfb(n) is determined to be out of the range defined by the upper and lower limits as a result of the processing at Step S232 and Step S235 above, the integration term will not be updated by the next time calculation at Step S13 (FIG. 1). If the integration term is otherwise updated while Dfb(n) is out of the range, the value of the integration term will be extraordinary so that when a normal condition in which Dfb(n) is within the range is restored, an appropriate feedback control term Dfb(n) will not be obtained smoothly. Thus, the elimination of updating of the integration term is intended to eliminate such a condition.

Step S236 . . . Dfb(n) is set to its lower limit value, that is, Dfbl. After this, the program advances to Step S27 of FIG. 1.

Step S238 . . . Dfb(n) is set to the value calculated at Step S24 of FIG. 1. After this, the program advances to Step S27 of FIG. 1.

Figure 9:
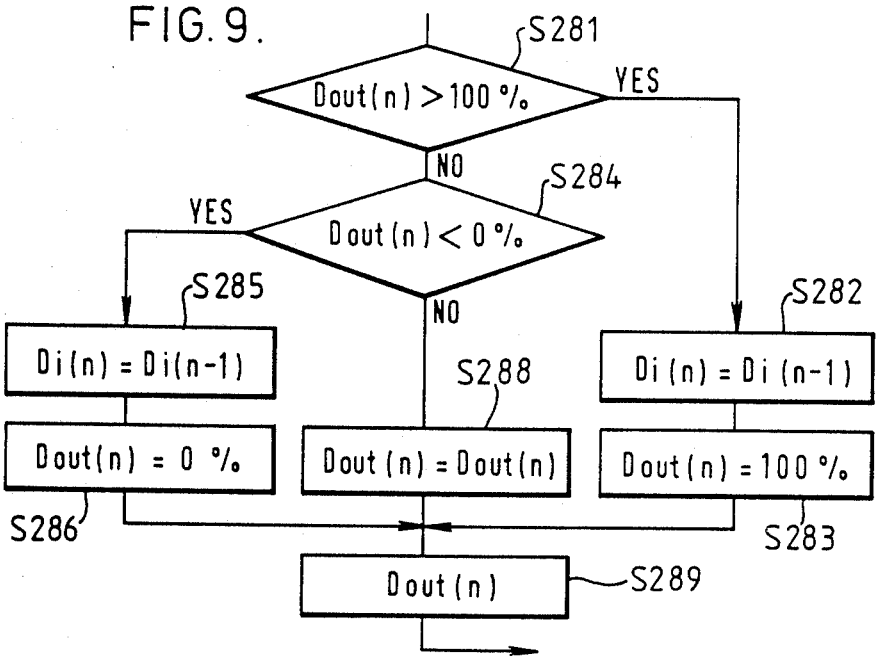
FIG. 9 is a flow chart illustrating contents of calculations at Step S31 of FIG. 1B.

FIG. 9 is a flow chart illustrating contents of calculations at Step S31 of FIG. 1.

Step S281 . . . it is determined whether or not Dout(n), calculated at Step S30 of FIG. 1, is greater than the 100% duty ratio of the output pulse signals of the microprocessor 4. When the determination is negative, the program advances to Step S284, and when the determination is affirmative, the program advances to Step S282.

Step S282 . . . the preceding integration value Di(n−1) which is stored in the preceding time value memory is stored in the memory 2 as the present integration value Di(n).

Step S283 . . . Dout(n) is set to the 100% duty ratio of the output pulse signals. The reason why Dout(n) is limited to the 100% duty ratio of the output pulse signals is that even if the solenoid current is controlled based on Dout(n) which is greater than the 100% duty ratio, a solenoid current actually corresponding thereto can not be obtained.

Step S284 . . . it is determined whether or not Dout(n) is smaller than the 0% duty ratio of the output pulse signals of the microprocessor 4. When the determination is negative, Dout(n) is considered to be within an appropriate range defined by the limit, and the program advances to Step S288. However, when the determination is affirmative, the program advances to Step S285.

Step S285 . . . the preceding integration value Di(n−1) is stored in the present time value memory in a similar manner as in Step S282 above.

When Dout(n) is out of the range defined by the upper and lower limits as a result of the processings of Step S282 and Step S285 above, the integration term will not be updated by the next time calculation at Step S13 (FIG. 1). The reason why the integration term is not updated in this manner is similar to that described above in connection with Step S235.

Step S286 . . . Dout(n) is set to the 0% duty ratio of the output pulse signals. The reason why Dout(n) is limited to the 0% duty ratio of the output pulse signals is that even if the solenoid current is controlled based on Dout(n) which is smaller than the 0% duty ratio, a solenoid current actually corresponding thereto can not be obtained.

Step S288 . . . Dout(n) is set to the value calculated at Step S30 of FIG. 1.

Step S289 . . . Dout(n) is outputted. In response to this, the microprocessor 4 successively develops pulse signals of a duty ratio corresponding to Dout(n) which are applied to the solenoid driving transistor 5.

Figure 10:
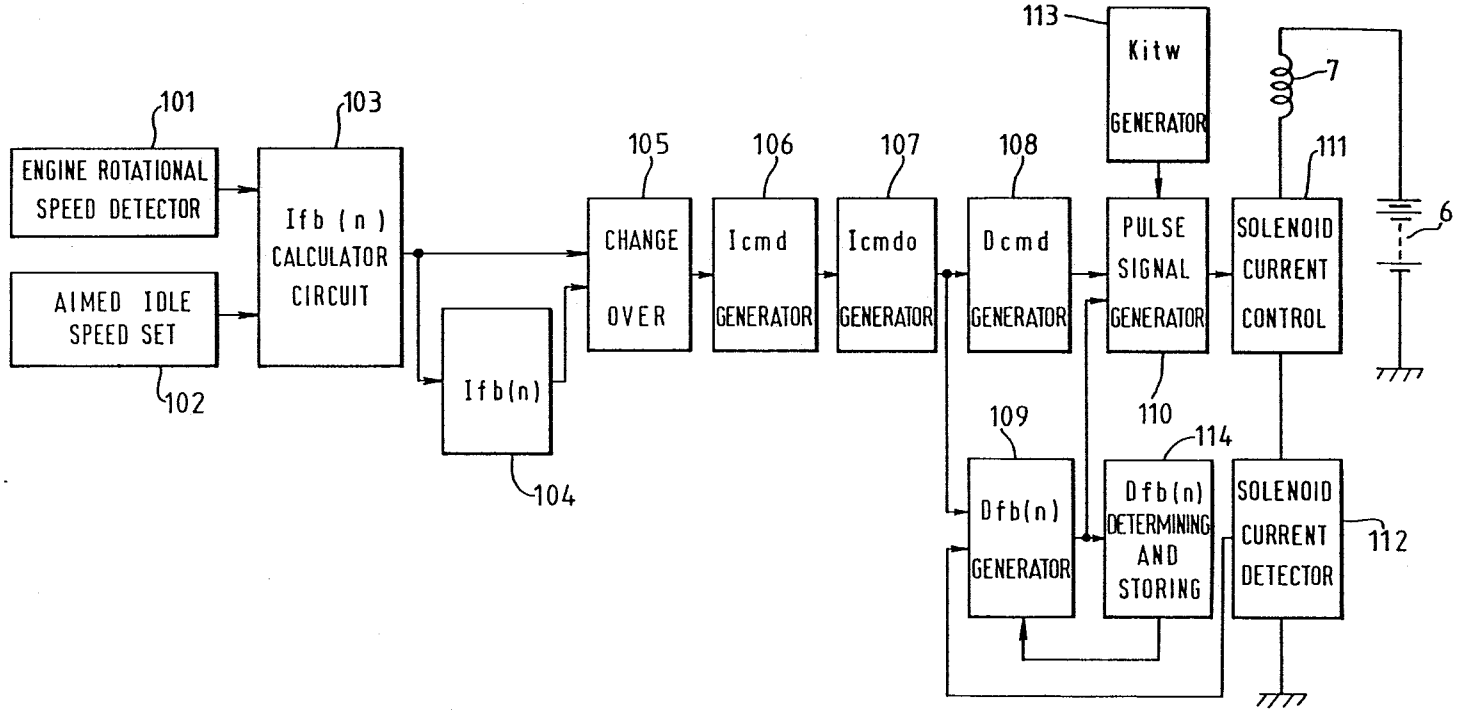
FIG. 10 is a block diagram of a solenoid current controlling device of the present invention.
Figure 11:
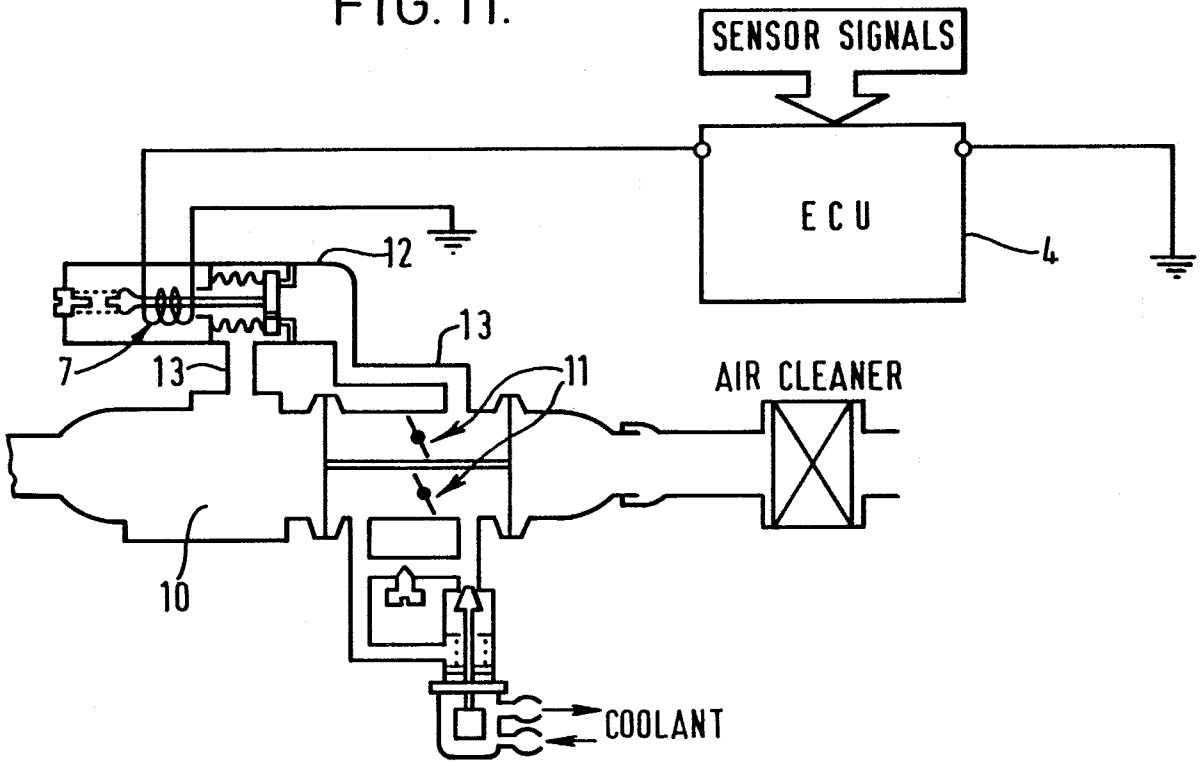
FIG. 11 is a schematic illustration of the throttle valve and solenoid valve in combination with an engine.

FIG. 10 is a block diagram illustrating the general functions of a solenoid current controlling device to which the present invention using the flow chart of FIGS. 1A and 1B is applied. Referring to FIG. 10, an engine rotational speed detecting means 101 detects the actual rotational speed of an engine and outputs Me(n), a reciprocal number of the engine rotational speed. An aimed idling rotational speed setting means 102 determines an aimed idling rotational speed Nrefo in accordance with the running conditions of the engine and develops a reciprocal number or value Mrefo.

An Ifb(n) calculating means 103 calculates a feedback control term If(b) from Me(n) and Mrefo and outputs it to a change-over means 105 and an Ifb(n) determining and storing means 104. The Ifb(n) determining and storing means 104 determines an integration term Iai(n) of the feedback control term Ifb(n) in accordance with equation (2) above and outputs a latest determined value Ixref.

The change-over means 105 supplies Ifb(n) outputted from the Ifb(n) calculating means 103 to an Icmd generating means 106 when a solenoid valve (not shown), the opening of which is proportionally controlled in response to an electric current flowing through a solenoid 7, is in the engine rotational speed feedback control mode. On the other hand, when the solenoid valve is in the open loop control mode, the change-over means 105 delivers the latest determined value Ixref outputted from the Ifb(n) determining and storing means 104 to the Icmd generating means 106.

The Icmd generating means 106 calculates a solenoid current control value Icmd, in accordance with equation (1) above when Ifb(n) is received. However, when Ixref is received, the Icmd generating means 106 calculates a solenoid current control value Icmd, in accordance with equation (3) above.

While not shown in the drawings, the correction terms of the equations (1) and (3) are supplied to the Icmd generating means 106. This Icmd is supplied to an Icmdo generating means 107.

The Icmdo generating means 107 reads out, in response to Icmd supplied thereto, an Icmd - Icmdo table which has been stored in advance and determines and outputs a corrected current control value Icmdo. This Icmdo is supplied to a Dcmd generating means 108 and a Dfb(n) generating means 109.

The Dcmd generating means 108 reads out, in response to Icmdo supplied thereto, an Icmdo - Dcmd table which has been stored in advance and determines a pulse duration Dcmd corresponding to the Icmdo and supplied it to a pulse signal generating means 110.

The Dfb(n) generating means 109 calculates a feedback control term Dfb(n) by equation (5A) from the Icmdo and an actual current value Iact which is an output of a solenoid current detecting means 112 which detects the electric current flowing through the solenoid 7 in response to on/off driving of the solenoid current controlling means 111. The Dfb(n) generating means 109 supplies Dfb(n) thus calculated to a Dfb(n) determining and storing means 114 and the pulse signal generating means 110.

It is to be noted that a latest determined value Dxref which is obtained by the Dfb(n) determining and storing means 114, which will be described below, is used as the preceding time integration term Di(n−1) in equation (5A) when an ignition switch is turned on to start the engine.

The Dfb(n) determining and storing means 114 determines an integration term Di(n) of the feedback control Dfb(n) in accordance with equation (4) above and outputs a latest determined value Dxref.

A Kitw generating means 113 detects the temperature TW of the cooling water of the engine which corresponds to the temperature of the solenoid and reads out, in response to TW, a TW - Kitw table which has been stored in advance therein to determine a temperature correction value Kitw. The Kitw generating means 113 then outputs the thus determined temperature correction value Kitw to the pulse signal generating means 110.

The pulse signal generating means 110 corrects the pulse time Dcmd supplied thereto in accordance with Dfb(n) and the temperature correction value Kitw and outputs a pulse signal having a thus corrected pulse duration Dout. The solenoid current controlling means 111 is driven on and off in response to the pulse signal supplied thereto.

As a result, the current from battery 6 flows through the solenoid 7, the solenoid current controlling means 111 and the solenoid current detecting means 112 to the ground.

As is apparent from the foregoing description, according to the present invention, following effects can be attained.

(1) In a solenoid current controlling method and apparatus wherein a pulse duration Dout(n) of output pulse signals of a microprocessor is determined from Dcmd(n) determined by an engine rotational speed feedback control system and Dfb(n) determined by a current feedback control system and wherein an attempt is made to provide a solenoid current corresponding to Dcmd(n) under control of the current feedback control system even if, for example, the resistance of the solenoid varies such that a condition in which solenoid current corresponding to Dcmd(n) based on the solenoid current control value does not occur, by provision of a temperature correction means for correcting the fluctuation in the solenoid current arising from a change in temperature of the solenoid, the engine rotational speed can be held to a predetermined rotational speed corresponding to Dcmd(n) irrespective of the control gain of the current feedback control system.

(2) Further, where Dfb(n) is determined and Dfb(n) upon starting of the engine is calculated based on the thus determined value, by provision of such a temperature correction means as described above, the determined value will not involve a component caused by a change in temperature of the solenoid. As a result, an appropriate determined value can be obtained and hence Dfb(n) will be a correct value upon starting of the engine.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. A method of controlling the solenoid current of a solenoid valve which controls suction air in an internal combustion engine, said method comprising the steps of:

calculating a solenoid current control value as a function of engine operating conditions;

detecting an engine coolant temperature corresponding to the solenoid temperature;

determining a temperature correction value in accordance with the solenoid temperature; and calculating a driving signal for controlling the operation of said solenoid as a function of the solenoid current control value and the temperature correction value.

2. A method of controlling the solenoid current of a solenoid valve which controls suction air in an internal combustion engine, said method comprising the steps of:

detecting the actual solenoid current flowing through said solenoid;

calculating a solenoid current control value as a function of engine operating conditions;

calculating a feedback control term as a function of the actual solenoid current and the solenoid current control value;

detecting an engine coolant temperature corresponding to the solenoid temperature;

determining a temperature correction value in accordance with the solenoid temperature; and calculating a pulse duration output signal for controlling the operation of said solenoid as a function of the feedback control term and the temperature correction value.

3. A method of controlling the solenoid current of a solenoid valve which controls the amount of suction air in an internal combustion engine, said method comprising the steps of:

detecting the actual solenoid current flowing through said solenoid;

calculating a solenoid current control value as a function of engine operating conditions;

determining a pulse duration signal as a function of the solenoid current value;

calculating a feedback control term as a function of the actual solenoid current and the solenoid current control value;

detecting an engine coolant temperature corresponding to the solenoid temperature and determining a temperature correction value; and calculating a pulse duration output signal for controlling the operation of said solenoid as a function of the pulse duration signal, the feedback control term, and the solenoid temperature correction value.

4. An apparatus for controlling the solenoid current of a solenoid valve which controls the amount of suction air in an internal combustion engine, said apparatus comprising:

(a) engine rotational speed detector means for detecting engine rotational speed;

(b) aimed idle speed setting means for generating a signal corresponding to a predetermined idling speed;

(c) first calculating means coupled to said engine rotational speed detector means and said aimed idle speed setting means for calculating a feedback control term (Ifb(n) as a function of an integration term (Iai), a proportion term (Ip), and a differentiation term (Id);

(d) first determining and storing means coupled to said first calculating means, for determining an integration term (Iai(n)) of the feedback control term (Ifb(n)) and for determining a determined value (Ixref) in accordance therewith;

(e) changeover means coupled to said first calculating means and said first determining and storing means for selecting the output of one of said first calculating means or said first determining and storing means;

(f) first signal generating means coupled to said changeover means for generating a solenoid current control value (Icmd) as a function of the output of said changeover means;

(g) second signal generating means coupled to the output of said first signal generating means, for generating a corrected current control value (Icmdo) corresponding to the current control value;

(h) third signal generating means coupled to said second signal generating means for generating a pulse duration signal (Dcmd) corresponding to the corrected current control value;

(i) solenoid current detector means, coupled to said solenoid valve, for detecting the current (Iact) flowing through the solenoid of said solenoid valve;

(j) fourth signal generating means coupled to the output of said second signal generating means and said solenoid current detector means for generating a feedback control term (Dfb(n));

(k) second determining and storing means, having an input coupled to said fourth signal generating means for determining the feedback control term as a function of the pulse duration signal and the solenoid current, and having an output coupled to said fourth signal generating means for applying the feedback control term to said fourth signal generating means;

(1) temperature correction means for detecting an engine temperature corresponding to the temperature of said solenoid and for generating a temperature correction value corresponding thereto; and (m) pulse signal generating means coupled to said third signal generating means, said fourth signal generating means and said temperature correction means for generating a solenoid control pulse (Dout), wherein said solenoid control pulse is applied to said solenoid for energizing said solenoid.

5. An apparatus as set forth in claim 4, wherein said second signal generating means includes a current control value (Icmd) - corrected current control value (Icmdo) table.

6. An apparatus as set forth in claim 4 wherein said third signal generating means includes a corrected current control value (Icmdo) - pulse duration signal (Dcmd) table.

* * * * *